US007587785B2

(12) United States Patent
Arner

(10) Patent No.: US 7,587,785 B2
(45) Date of Patent: Sep. 15, 2009

(54) VACUUM COLLECTION DEVICE USEFUL IN YARD MAINTENANCE

(76) Inventor: Jody R. Arner, 3956 Blacksmith Rd., New Tripoli, PA (US) 18066

( * ) Notice: Subject to any disclaimer, the term of this patent is extended or adjusted under 35 U.S.C. 154(b) by 504 days.

(21) Appl. No.: 11/216,206

(22) Filed: Aug. 31, 2005

(65) Prior Publication Data

US 2007/0044271 A1 Mar. 1, 2007

(51) Int. Cl.
*A47L 5/00* (2006.01)

(52) U.S. Cl. ..... 15/327.5; 15/344; 15/345

(58) Field of Classification Search ..... 15/327.5, 15/344, 345; *A47L 5/00*
See application file for complete search history.

(56) References Cited

U.S. PATENT DOCUMENTS

| | | | | |
|---|---|---|---|---|
| 3,286,446 | A | 11/1966 | Happe et al. | |
| 4,552,100 | A | 11/1985 | Kawaharazuka et al. | |
| 4,870,714 | A * | 10/1989 | Miner | 15/327.5 |
| 5,267,371 | A * | 12/1993 | Soler et al. | 15/327.5 |
| 5,503,090 | A | 4/1996 | Guzan | |
| 5,586,359 | A | 12/1996 | Iida | |
| D398,426 | S | 9/1998 | Bisson | |
| 6,073,301 | A | 6/2000 | Berfield | |
| 6,131,239 | A | 10/2000 | White | |
| 6,253,415 | B1 | 7/2001 | Honda | |
| 6,305,048 | B1 | 10/2001 | Salisian | |
| 6,574,829 | B1 | 6/2003 | Marcum et al. | |
| 7,134,165 | B2 * | 11/2006 | Pullins | 15/352 |
| 2001/0042283 | A1 * | 11/2001 | Oh et al. | 15/353 |

OTHER PUBLICATIONS

Black & Decker Product Listing:Blower Vacs & Attachments. The Black & Decker Corporation, 2000-2004 [retrieved on Feb. 23, 2005]. Retrieved from the Internet: www.blankanddecker.com/productguide/ProductListByType.aspx?RHID=1424.html.

* cited by examiner

*Primary Examiner*—David A Redding
(74) *Attorney, Agent, or Firm*—Winston & Strawn LLP; Richard P. Gilly

(57) ABSTRACT

A portable, vacuum-powered collection device is useful in yard maintenance and other similar applications where debris, some of which may be bulky, is being collected. The collection device makes use of a receptacle adapted to be worn on a user's back during operation. The receptacle has an opening for emptying its contents. A vacuum unit is operatively associated with the receptacle so that it can move leaves through an intake passage and collect them in the receptacle. In one implementation, the receptacle includes a lid secured to cover a corresponding opening in the bottom portion of the receptacle. When the lid is opened, the contents of the receptacle can be emptied. In certain other implementations, a mechanism is included in the collection device which is configured or adapted so that the user can selectively open the lid to empty the contents of the receptacle while still wearing the receptacle on the back.

17 Claims, 1 Drawing Sheet

102
120
100
160
112
113
117
122
124
162
150
118
130
108
105
106
110
107
116
119
146
104
114
148

162
112
106
117
102
160
113
144
157
115
132
136
134
152
155
140
142
118
138
116

160
113
132
157
112
155
138
136
142
181
118
119
116
115
152
140
141

160
113
132
144
118
183
112
145
115
140
181
152
116
104

122
106
146
121
148

VACUUM COLLECTION DEVICE USEFUL IN YARD MAINTENANCE

TECHNICAL FIELD

This invention relates to vacuum collection devices useful in yard maintenance.

BACKGROUND

The need to collect leaves and other bulky debris from a yard or lawn has spawned so-called leaf collection devices or leaf collectors. These devices often use motors to vacuum up the yard debris, and a bag to collect the debris.

These devices suffer from various drawbacks and disadvantages. For example, leaf collectors are often unwieldy. The user often is unable to maneuver easily and has difficulty vacuuming hard-to-reach places. The unwieldiness may be compounded when the collection bag or bin becomes full.

In addition, yard waste often accumulates quickly in such collectors, requiring frequent emptying of the bulky collection bag. The emptying procedure is often not ideal or efficient, a problem which is only compounded when there is need for frequent emptying of bulky yard debris.

SUMMARY

A portable, vacuum-powered leaf collector uses a collection unit adapted to be worn on the user's back during its operation. An elongated member has an intake passage defined therein and can be positioned near leaves or other yard debris to be collected. A vacuum unit is coupled to the intake passage and the collection unit so that it moves leaves through the intake passage and into the collection unit. The collection unit has a volume for receiving the leaves therein. The collection unit is designed to remain substantially between the user's shoulders. In this way, the user can circulate between obstacles which are spaced from each other by a distance similar to the width of the user.

In one implementation, the leaf collector includes a mechanism which allows the user to selectively open the collection unit to empty its contents while still wearing the collection unit on the back.

Although the mechanism can be electrical, electronic, electro-mechanical, or mechanical, one suitable mechanism makes use of a release which can be manually activated by the user in order to open a lid covering a corresponding opening in the collection unit.

Some versions of the inventive collector can make use of a cable which can be accessed by the user when the collector is being worn on his or her back. The cable, in turn, is operatively connected to the lid, and the release is operatively associated with the cable. In this way, the user pulls or otherwise manipulates the cable to open or close the lid.

BRIEF DESCRIPTION OF DRAWINGS

Like reference symbols in the various drawings indicate like elements.

DESCRIPTION

Figure 1:
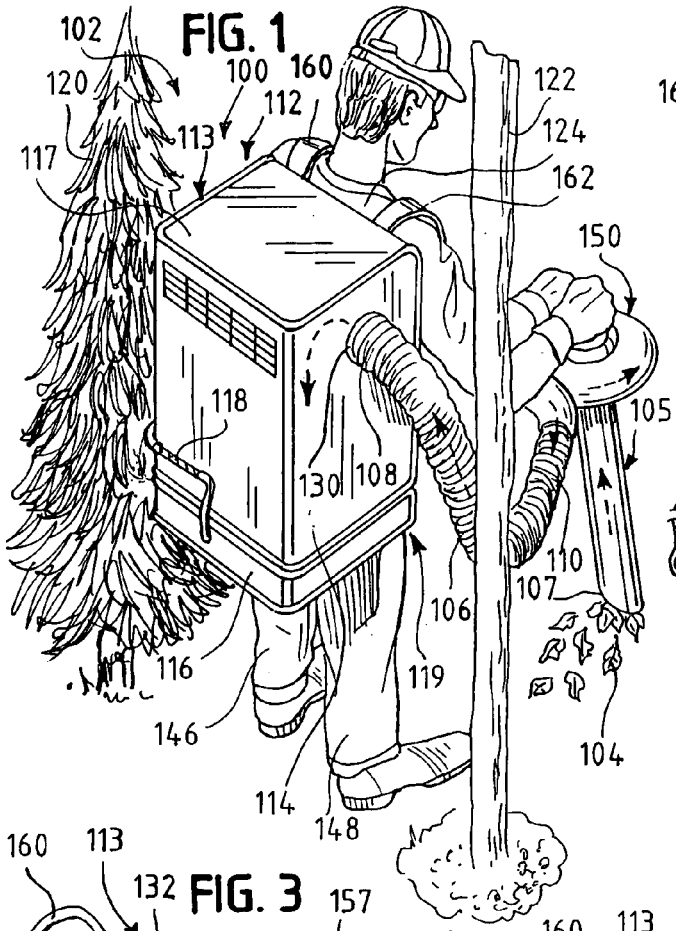
FIG. 1 is a perspective view of the collection device shown in one exemplary environment.
Figure 2:
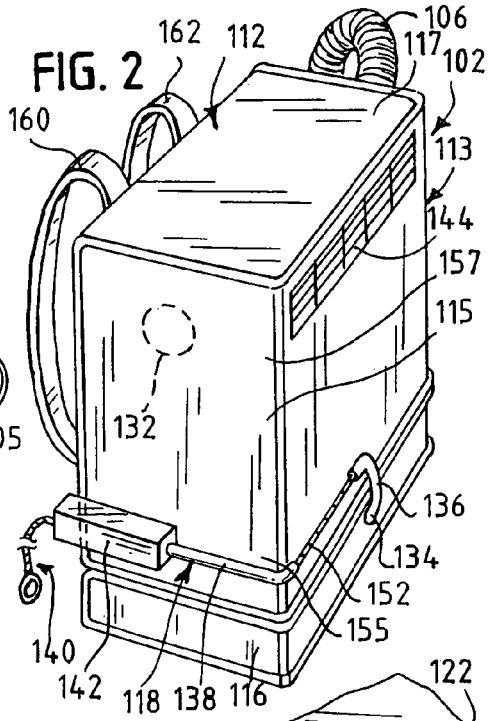
FIG. 2 is a further perspective view of the device of FIG. 1.

Referring now to the drawings, and in particular to FIG. 1, a collection device in the form of a portable, vacuum-powered leaf collector 100 is shown with a receptacle 112 strapped to the user's back and thereby enabling the user to better maneuver the device, such as into tight spots formed between trees 120, 122.

Operations of collector 100 are likewise facilitated by equipping receptacle 112 with a lid 116 which opens from the bottom of the receptacle 112 to dump out its contents. Lid 116 is selectively opened by a suitable mechanism 118.

Leaves or other yard debris 104 are collected into receptacle 112 by means of any suitable vacuum unit 150, operatively connected to receptacle 112 through an intake passage defined by flexible tubing 106. One suitable form of vacuum unit 150 includes a hand-held "wand" 105 with a blower motor configured to draw debris 104 into an opening 107 at the distal end of wand 105. It will be appreciated by those skilled in the art that the power of the vacuum unit 150 is selected to transport debris from wand 105 through the intake passage formed by tubing 106 until it exits tubing 106 at the inlet 108 to receptacle 112.

Referring now more particularly to FIGS. 2-5, mechanism 118 for selectively opening lid 116 includes a suitable cable, cord, or string 152 secured to lid 116 at one end and terminating in a handle end 140 at its other end. Cable 152 extends from the back of receptacle 112 around to its front, so that a handle 141 secured to handle end 140 is accessible to the user. Suitable guide portions 136, 138 are provided to maintain the cable 152 in the appropriate position for operation by the user.

Figure 3:
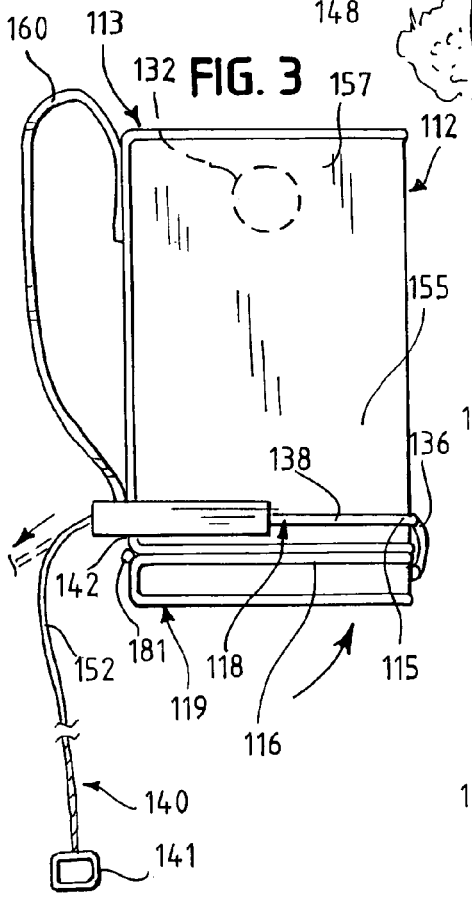
FIGS. 3 and 4 are side elevation views of the device of the preceding figures.
Figure 4:
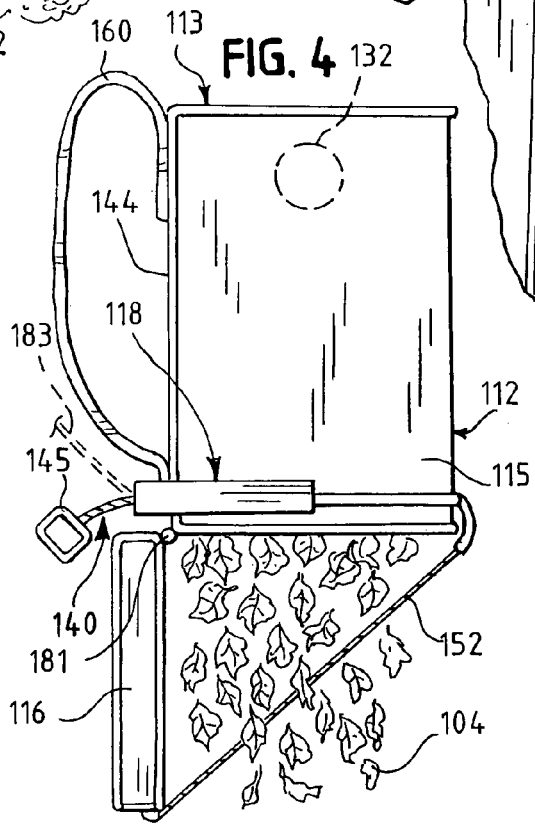
Figure 5:
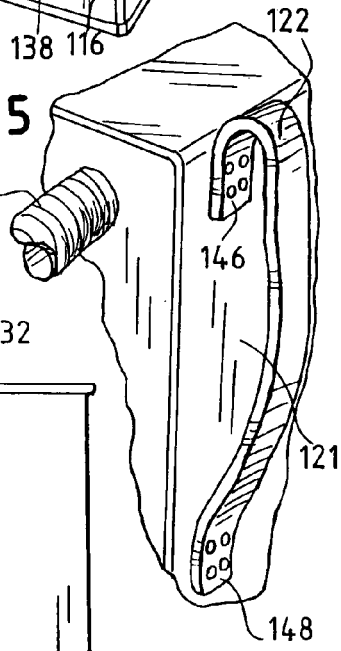
FIG. 5 is a partial perspective view of the device of the proceeding figures.

A release device 142 engages or otherwise is operatively associated with cable 152 to selectively open and close lid 116. More particularly, release device 142 operates to hold cable 152 in a position so that lid 116 remains closed as shown in FIG. 3. Release device 142 further operates so that the user can manipulate the handle end 140 of cable 152 to release the cable from its position in FIG. 3, upon which release lid 116 opens, as shown in FIG. 4. Any accumulated debris 104 in receptacle 112 falls out the opening. Preferably, the weight of lid 116 is sufficient to cause cable 152 to move through release device 142 and any associated guides to open lid 116 as shown in FIG. 4. Suitable springs may optionally be included to urge lid 116 open upon activation of mechanism 118.

One suitable release device 142 includes spring loaded or cammed surfaces (not shown) which selectively engage portions of cable 152 received in release device 142. Such a release device would permit the user to close or reclose lid 116 from its open position shown in FIG. 4 by pulling handle end 140 of cable 152 "forward," that is, toward the front of the user when the device is being worn on the back. Once lid 116 has been closed, release device 142 would act to engage cable 152 to hold lid 116 closed over receptacle 112. Release device 142 could be further actuated to release cable 152 by pulling handle end 140 of cable 152 either further forward or in a predetermined direction which releases the elements (not shown) otherwise engaging cable 152. Thus, for example, cable 152 can be tugged upwardly to the orientation 183, shown in phantom in FIG. 4, to release cable 152 to open lid 116.

In the implementation illustrated in FIGS. 1-5, receptacle 112, which holds debris 104, is defined by a boxed-shaped housing 113 with opposite sides 115, top 117, and bottom 119. Housing 113 includes a bottom portion 155 associated with emptying of the receptacle 112 and a top portion 157 associated with intake of debris 104. Housing 113 is formed of rigid or semi-rigid material, such as plastic or other polymeric material. In this implementation, the opening out of which debris 104 falls when lid 116 is opened substantially corresponds to the entire bottom 119 of housing 113. Lid 116 comprises a single panel or door and substantially defines bottom 119 by covering the opening defined in the bottom of the housing. Lid 116 is secured at one of its edges to housing 113 by a suitable hinge or hinges, one of which is shown at 181.

Housing 113 has a surface 121 (FIG. 5) which is generally positioned proximate to or adjacent to the user's back, as well as an opposite surface 123 which generally faces outwardly from the user. Suitable means are provided for the user to carry housing 113 on his or her back, such means shown here as a pair of straps 160, 162 secured to surface 121. Surface 123 includes an exhaust vent 144 through which air sucked into receptacle 112 exits collector 100. Vent 144 is equipped with a suitable baffle and screen to retain collected debris within receptacle 112 while permitting appropriate vacuuming force to be exerted through vacuum unit 150.

Housing 113 is constructed so that tubing 106 can be selectively inserted into either of the sides 115. Thus, referring to FIG. 1, tubing 106 is secured to the right side of housing 113. However, a cut-out, cap, or other cover 132 is provided on the left side 115 (FIG. 2) to cover an alternate connection site for tubing 106, in case it is desirable for tubing 106 to extend out of the left side, such as for left-handed operation by the user.

Housing 113 is preferably dimensioned to have a width that does not extend past a typical user's shoulders, such as between 1 and 2 feet.

Mechanism 118 for selectively opening lid 116 is configured or located so that the user can actuate it while wearing housing 113 on his or her back. In this way, collection device 100 can be emptied more efficiently.

It will be appreciated that FIGS. 1-5 and the associated discussion relate to just one of many possible implementations of a vacuum collection device according to the present invention. Numerous alternative embodiments are likewise within the scope of this disclosure. So, for example, although the implementation of FIGS. 1-5 locate the vacuum unit 150 at the end of tubing 106, such vacuum unit 150, alternately, could be positioned at the proximal end of tubing 106, or adjacent, proximate to, or within housing 113. In such configuration, the user would simply be manipulating an opening at the end of flexible tubing 106 with vacuum power being provided to tubing 106 further "up stream" from opening 107.

Housing 113 and receptacle 112 are likewise capable of numerous alternative implementations. That is, for example, rather than using a rigid or semi-rigid material to define housing 113 and receptacle 112, a canvas bag or container can be configured to be wearable by the user like a backpack. Such canvas bag or container can include suitable rigid framing elements (not shown) to define a suitable opening in the bottom of receptacle 112, and a suitable lid 116 to cover such opening. In such alternative embodiments, the canvas or other porous material defining receptacle 112 eliminates the need for exhaust vent 144 and its related structures, as air passing through collector 100 is vented through the porous material of the canvas.

While the illustrated implementation shows lid 116 comprising substantially the bottom 119 of receptacle 112, lid 116 can be only a portion of bottom 119. Furthermore, while lid 116 is shown located on bottom 119, lid 116 and its corresponding opening can alternately be located at other suitable locations on receptacle 112 or housing 113, preferably bottom portion 155 of housing 113. Thus, for example, lid 116 and the corresponding opening can be located toward the lower end of surface 123, which is oriented opposite the user's back. Receptacle 112 in such alternate implementation can be suitably adapted to encourage collected debris to exit the opening located in the "back" surface 123 of housing 113.

As a still further alternative, housing 113 can be comprised of one or more modules or telescoping components (not shown) to vary the size of receptacle 112 defined by housing 113 to suit particular applications or particular customer markets.

There are likewise numerous alternative implementations of mechanism 118 suitable for the leaf collection device. Thus, for example, although mechanism 118 makes use of a handle 140 pulled or released by the user, mechanism 118 could make use of a solenoid or other electrically activatable component to wind and unwind cable 152 between the two positions show in FIGS. 3 and 4. The term "mechanism" thus includes electric or electronic implementations, and such implementations of release mechanism 118 or release device 142 could simply require the user to open or close a corresponding switch or otherwise electrically activate mechanism 118 or release mechanism 142.

Mechanism 118 likewise does not necessarily need to use cable 152 at all, instead relying on reclosable latches, springs, or other mechanical elements which permit the user to selectively move the lid between closed and open positions. Further alternatives to collection device 100 could be constructed without any mechanism 118, or with mechanism 118 only being actuatable when device 100 is not being worn on the user's back. In such cases, for example, lid 116 could be opened and shut by means of a simple, reclosable latch, or spring hinge.

Tubing 106 is sized to create a velocity sufficient to carry the debris into the collection device but not so high a velocity as to result in excessive resistance and back pressure on the vacuum exhaust. Tubing 106 is formed of a material which is flexible, with a relatively smooth inside surface to minimize resistance to debris flow, and sufficiently strong to undergo normal use in yard maintenance.

Operation of device 100 is readily apparent from the foregoing description. The user straps housing 113 to his or her back and grasps vacuum unit 150 and the associated wand 105 in the appropriate hand or hands. The vacuum unit whether electric- or gas-powered, is turned on, and opening 107 in wand 105 is positioned near debris to be collected, such as leaves or other yard waste 104. The shoulder-width and back-mounting of the device enables the user to readily access areas to be cleared of debris even if required to walk between closely spaced objects, such as trees 120, 122, bushes, and the like.

When receptacle 112 is sufficiently full, the user empties receptacle 112 without necessarily needing to remove housing 113 from his or her back or even turn off vacuum unit 150. Rather, the user simply walks to the location where the debris is to be emptied and actuates the mechanism 118 to open lid 116. Since, in this implementation, the lid 116 is hingedly connected to open away from the user's back, the debris falls away without soiling the user. Once debris 104 has been emptied from receptacle 112, the user actuates mechanism 118 to close lid 116. In this implementation, the user pulls handle end 140 of cable 152 to bring lid 116 back to engagement with the corresponding opening at bottom 119 of housing 113.

The above described process is repeated as many times as required to collect the debris in the area in question.

While the invention has been described with reference to certain embodiments, as well as alternative embodiments, it will be appreciated that still further variations are within the scope of this disclosure and the corresponding claims set out herein.

What is claimed is:

1. A portable, vacuum-powered leaf collector, comprising:

a receptacle dimensioned to hold leaves and adapted to be worn on a user's back during operation, the receptacle having an opening for emptying contents of the receptacle;

an elongated member with an intake passage defined therein, the intake passage having an opening positionable near leaves to be collected;

a vacuum unit operatively coupled to the intake passage and the receptacle to move the leaves through the intake passage and collect them in the receptacle;

a lid secured to cover the opening in the receptacle; and a mechanism adapted to allow the user to selectively open the lid to empty the contents of the receptacle while wearing the receptacle on the back wherein the mechanism comprises a release activatable by the user to open the lid, a cable operatively connected to the lid, and wherein the release is operatively associated with the cable.

2. The leaf collector of claim 1, wherein the receptacle is defined by a housing having a bottom portion with a bottom, wherein the opening is defined in the bottom portion.

3. The leaf collector of claim 2, wherein the opening is defined in the bottom of the bottom portion, and wherein the lid is oriented to open downwardly.

4. The leaf collector of claim 2, wherein the lid comprises at least one panel.

5. The leaf collector of claim 4, wherein the panel has an edge hingedly secured to the housing.

6. The leaf collector of claim 2, wherein the housing includes at least some substantially rigid portions and includes an inlet through which air is drawn into the receptacle and a baffle through which air exists the housing.

7. The leaf collector of claim 2, wherein the housing has an average width between one and two feet, whereby the housing width does not extend beyond the shoulders of the user.

8. The leaf collector of claim 1, wherein the lid is slidable relative to the receptacle.

9. The leaf collector of claim 1, wherein the receptacle includes a portion defining an inlet therein, the inlet communicating with the intake passage to receive debris therethrough for collection in the receptacle.

10. The leaf collector of claim 1, wherein the receptacle includes left and right sides corresponding to the left and right sides of the user, and the sides are configured to permit the elongated member to be selectively attached to either one of the sides, thereby accommodating left- or right-handed operation of the collector.

11. The leaf collector of claim 1, wherein the mechanism is further adapted to close the lid while the user is wearing the receptacle.

12. A portable, vacuum-powered collection device useful in yard maintenance, the device comprising:

a housing having at least some substantially rigid portions dimensioned to be worn on the user's back, and having a volume defined therein for collecting debris, the housing having an overall width selected so as not to extend laterally beyond the user's shoulders, thereby facilitating use of the device in tight spots in the yard, the housing having upper and lower portions;

a vacuum assembly operatively connected to the housing to collect the debris in the housing;

an opening defined in the lower portion of the housing;

a movable lid for the opening; and a mechanism adapted to allow the user to selectively open the lid while the user is wearing the receptacle, wherein the mechanism comprises a release activatable by the user to open the lid, and a cable operatively connected to the release.

13. The device of claim 12, further comprising a receptacle defined by the housing, the receptacle in communication with the vacuum assembly to receive the debris therein.

14. The device of claim 12, wherein the lid comprises a door hingedly secured relative to the housing.

15. The device of claim 14, wherein the door comprises at least one panel having an edge hingedly connected to the housing.

16. The device of claim 12, wherein the vacuum assembly comprises a handheld vacuum unit, and further comprising flexible tubing defining an inlet passage, the vacuum unit being in operative communication with the housing though the tubing.

17. The method of collecting debris from an area to be cleared, the debris including leaves or other yard material, the method comprising the steps of:

carrying a collection unit in a desired position relative to the user's body;

operating a vacuum unit to draw leaves from the area to be cleared through an intake passage and into the volume of the collection unit;

moving the collection unit from the area to be cleared to a location for depositing the debris collected in the volume;

opening the collection unit while it is in the desired position in which it is being carried, whereby the contents of the collection unit are emptied, wherein the step of carrying the collection unit in a desired position comprises wearing the collection unit on the back between the shoulders; and wherein the step of opening the collection unit comprises releasing a door while wearing the unit on the back.

* * * * *